US006752242B1

(12) United States Patent
Whitehead et al.

(10) Patent No.: US 6,752,242 B1
(45) Date of Patent: Jun. 22, 2004

(54) WOOD POLE FALL PROTECTION DEVICE

(75) Inventors: Robert Whitehead, Montrose, PA (US); John Matias, Binghamton, NY (US)

(73) Assignee: Buckingham Manufacturing Co., Inc., Binghamton, NY (US)

( * ) Notice: Subject to any disclaimer, the term of this patent is extended or adjusted under 35 U.S.C. 154(b) by 0 days.

(21) Appl. No.: 10/347,556

(22) Filed: Jan. 21, 2003

(51) Int. Cl.[7] ..... A62B 35/00
(52) U.S. Cl. ..... 182/9; 182/133
(58) Field of Search ..... 182/9, 133, 134

(56) References Cited

U.S. PATENT DOCUMENTS 1,802,288 A * 4/1931 Strauss ..... 182/9
2,601,589 A * 6/1952 Childers, Sr. ..... 182/9
4,712,646 A * 12/1987 Page ..... 182/9
5,137,113 A * 8/1992 Lortie ..... 182/9
5,141,074 A * 8/1992 Sulowski et al. ..... 182/9

* cited by examiner

*Primary Examiner*—Alvin Chin-Shue
(74) *Attorney, Agent, or Firm*—Mark Levy & Associates

(57) ABSTRACT

A wood pole fall protection device for line technicians and pole climbers that allows travel up and down a wooden pole without incurring a fall or injury. The wood pole fall protection device is also designed to provide the line technician with the ability to rotate or twist in the straps as well as negotiate and maneuver around obstacles and obstructions encountered upon the pole.

11 Claims, 5 Drawing Sheets

WOOD POLE FALL PROTECTION DEVICE

FIELD OF THE INVENTION

The present invention relates to pole climbing equipment and, more particularly, to a wood pole fall protection device for linemen and pole climbers when used in conjunction with a lineman's body belt and retractable lanyard, protects the user from experiencing dangerous falls and sustaining injuries while working upon, positioning upon, ascending, or descending the pole.

BACKGROUND OF THE INVENTION

Injuries sustained by linemen and pole climbers are legendary. Many devices have been invented attempting to prevent linemen falling from the pole and injuring themselves. One such safety device is a LINEMAN'S SAFETY STRAP ASSEMBLY, illustrated in U.S. Pat. No. 5,137,113, issued on Aug. 11, 1992 to Michel Lortie. This safety strap assembly incorporates a climber's body belt. The strap assembly comprises a pole strap having two ends with a loop extending from a base plate attached to the body belt. The loop can be opened to allow the user to respectively engage and disengage the loop from the utility pole. A brake mechanism is attached to the base plate. The brake mechanism comprises a cam that engages a strap or cross belt of the body belt as it passes over the brake plate. The cam is adjustable by a lever, providing frictional force between the cross belt and the brake plate. The friction applied to the cross belt prevents it from sliding past the brake plate and subsequently tightening the loop.

The safety strap assembly allows the lineman or pole climber to push the pole strap up or down the pole as he ascends or descends the pole. In the event the lineman loses his footing on the pole, a tugging force applied by the body belt will release the brake mechanism, thus allowing the tightening of the loop of the pole strap. The pole strap will then tighten about the pole and prevent a fall.

Although the safety strap assembly of the aforementioned patent works to prevent a fall in the course of normal operation, it has two major drawbacks. The safety strap does not allow the lineman to twist his body while he is working. Should the lineman twist his body using this safety strap assembly, the body strap will tug upon the brake mechanism, causing it to release and tighten the loop of the pole strap. The lineman would then have to readjust the pole strap in order to ascend and descend the pole. Therefore, in the normal course of a work shift the lineman would be required to adjust and readjust this safety strap assembly too many times for reasonable comfort and control. More importantly, the safety strap assembly of the aforementioned patent does not protect the lineman when he has to maneuver around obstacles.

It would be advantageous to provide a strap assembly for linemen that safeguards against injuries and falls.

It would also be advantageous to provide a strap assembly that allows a lineman to twist his body while he is working.

It would further be advantageous to provide a strap assembly that protects a lineman while he maneuvers around obstacles.

The strap assembly of the present invention is a unique pole-engaging device that grips the pole when the weight of the user is applied during work positioning, twisting, or in the event of a fall. The strap assembly of the current invention therefore allows for body rotation. The assembly of this invention protects the user against falls while ascending or descending the pole, and also when climbing over obstacles or obstructions. The strap assembly of the present invention comprises a retractable lanyard that attaches to the body belt and allows the lineman to twist and maneuver over pole obstructions with ease.

SUMMARY OF THE INVENTION

In accordance with the present invention, there is provided a wood pole fall protection device for linemen and pole climbers. The inventive device allows the user to ascend and descend the pole, but in the event of a cutout (a leading cause of injuries to line technicians and wooden pole climbers), an obstruction, or an obstacle, the straps of the wood pole fall protection device of this invention will tighten around the wooden pole to arrest a potential fall.

The wood pole fall protection device comprises an inner strap (positioning strap) having a buckle for adjusting the strap. The buckle is attached to one of two locking snap hooks. The buckle allows the line technician to adjust the strap of the device for proper positioning about the pole. The inner strap passes through, and is slidable in, a carabiner connector that attaches to the outer strap. The inner strap passes through a handle/paddle assembly attached to the outer strap.

The outer strap of the device passes through the buckle portion of the handle/paddle assembly and is able to slide through the assembly. The line technician uses the wood pole fall protection device to hitchhike up and down the pole. This is accomplished by grasping the handle/paddle in one hand, and the carabiner connector in the other hand. The line technician allows one to two inches of space between the pole and the inner strap, and leans toward the pole. The slack allows the line technician to slide the device up or down the pole using the hitchhike method known in the art. The technician then leans backward to cinch the pole strap about the pole. The lineman can then adjust the strap through the buckle to provide body strap comfort.

While in the work position, the line technician can freely rotate the inner strap through the integrated rollers to gain rotational movement while working. The lineman can achieve adjustments of position by repositioning his feet in a desired direction, leaning forward, and rotating the device about the wooden pole. The line technician can then lean back is to allow the device to cinch the pole. The lineman can maneuver around obstacles or obstructions like a telephone cable or cross arm by leaning back on the pole to allow the device to cinch the pole, and then simply taking the strap of the retractable lanyard over the obstruction and connecting it to the opposite body belt "D" ring.

Once the retractable lanyard is secure over the obstruction, the tension is released on the outer strap by depressing the cam buckle on the handle/paddle assembly and lengthening the strap. Once the outer strap is lengthened, the carabiner connector is pulled around to the front and can be disconnected. The line technician then climbs a few steps up and adjusts as necessary to accommodate for pole taper, and reconnects the wood pole fall protection device over the obstruction. The retractable lanyard snap hook is disconnected and the line technician continues to ascend. These steps are repeated as necessary until the desired work position is reached.

BRIEF DESCRIPTION OF THE DRAWINGS

A complete understanding of the present invention may be obtained by reference to the accompanying drawings, when considered in conjunction with the subsequent detailed description.

DESCRIPTION OF THE PREFERRED EMBODIMENT

The present invention features a wood pole fall protection device for line technicians and pole climbers. When used in conjunction with a lineman's body belt, the device allows the lineman to travel up and down a wooden pole while being fall protected. Additionally, when used with a retractable lanyard, the device is designed to provide the line technician/pole climber with the ability to rotate around the pole, as well as negotiate and maneuver around obstacles and obstructions encountered on the pole.

Figure 1:
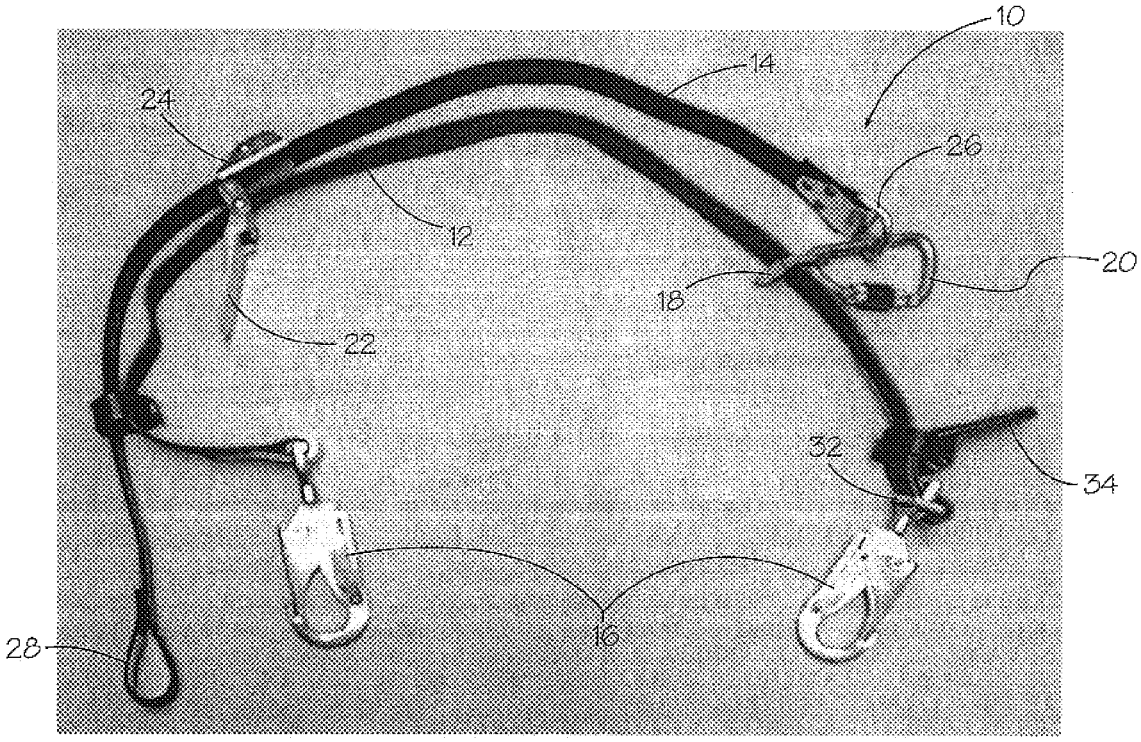
FIG. 1 illustrates a perspective plan view of the wood pole fall protection device for pole climbers/linemen, in accordance with this invention.

Now referring to FIG. 1, the wood pole fall protection device 10 of this invention is illustrated. The device 10 comprises an inner strap (positioning strap) 12 that attaches to the "D" rings of the work positioning belt worn by the lineman (not shown), and an outer strap 14 that encircles the outside diameter of the wooden pole (not shown) on which the lineman is working. The device 10 also comprises two locking snap hooks 16 that attach to the "D" rings of the work positioning belt worn by the line technician/pole climber.

The inner strap 12 loops through the "D" piece 18 of a carabiner connector 20 that is attached to the outer strap 14 on a distal end thereof. The inner strap 12 loops through a cam buckle 24 that forms part of a handle/paddle 22. A distal end of the outer strap 14 attaches to the carabiner connector 20 through an intermediate ring connector 26. The other distal end of the outer strap 14 is characterized or defined by a loop 28. The outer strap 14 can be pushed through the cam buckle 24 to extend and enlarge the loop formed about the wooden pole 30 shown in FIG. 2.

The wood pole fall protection device 10 allows the lineman to hitchhike up and down the pole 30, but in the event of a cutout, obstruction, or obstacle, the inner strap 12 will tighten around the wooden pole 30 to arrest a potential fall. In one embodiment, a link 32 is attached to one of the locking snap hooks 16 and is used for tightening the inner strap 12 about the wooden pole 30. The inner strap 12 passes through a handle/paddle assembly 22, which is connected to the inner strap 12 through a cam buckle 24.

As aforementioned, inner strap 12 is able to slide through the handle/paddle assembly 22 by pushing upon the outer strap 14, as shown in FIG. 1. The line technician uses outer strap 14 to hitch up and down the pole 30. This is easily accomplished by grasping the handle/paddle 22 in one hand, and the carabiner connector 20 in the other hand.

Figure 2:
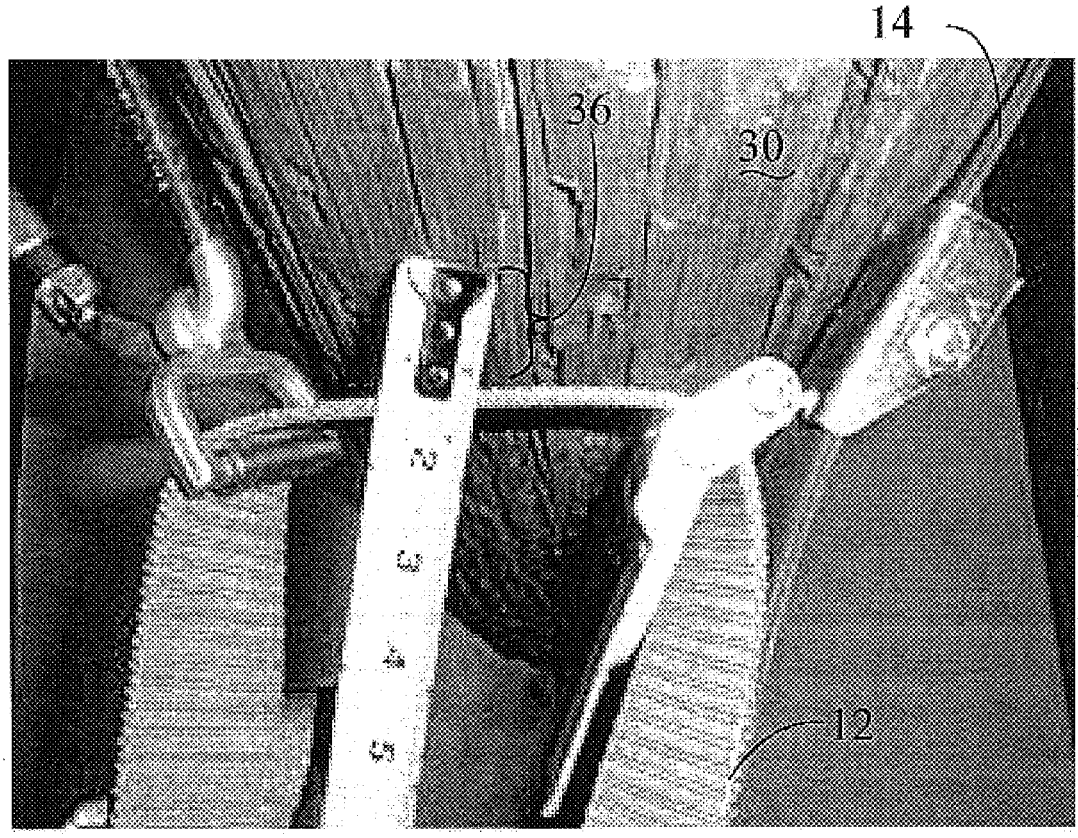
FIG. 2 depicts an in situ perspective view of the device illustrated in FIG. 1, as the lineman prepares to adjust the device about the wooden pole.

Referring to FIG. 2, the line technician allows one to two inches of space 36 between the inner strap 12 and the pole 30 and a minimum clearance of approximately one-third the circumference of the pole 30 between the "D" piece of the carabiner 18 and the handle/paddle 22, and leans toward the pole 30. The slack allows the line technician to slide the device 10 up or down the pole 30 using the hitchhike method known in the art. The technician then leans backward to cinch the outer strap 14 about the pole 30. The lineman can then adjust the inner strap 12 through the link 32 through use of the web handle 34. The line technician can freely rotate the device 10 and achieve adjustments of position by repositioning his feet in the desired direction, leaning forward, and rotating the device 10 about the wooden pole 30. The line technician can then properly adjust the device 10 and lean back to secure and tighten the outer strap 14 around the pole 30.

The lineman can maneuver around obstacles or obstructions like a telephone cable or cross arm (not shown) by leaning back upon the pole 30 to allow the outer strap 14 to cinch the pole 30, and then simply taking the strap of the retractable lanyard (not shown) over the obstruction and connecting it to the opposite side body belt "D" ring.

Once the retractable lanyard (not shown) is secure over the obstruction, the tension is released on the outer strap 14 by depressing the cam buckle 24 on the handle/paddle assembly 22 and lengthening the strap 14. Once the outer strap 14 is lengthened, the carabiner connector 20 is pulled around to the front and can be disconnected. The line technician then climbs a few steps up and adjusts as necessary to accommodate for pole taper, and reconnects the wood pole fall protection device 10 over the obstruction. The retractable lanyard snap hook is disconnected and the line technician continues to ascend. These steps are repeated as necessary until the desired work position is reached.

In testing performed on wet and dry poles, the wood pole fall protection device 10 limited downward travel to less than 6 inches (less than 2 inches in almost 100% of tests). Testing was also performed on iced poles (1" ice coating covering the entire pole surface). Varying results were obtained during the ice testing, with downward travel ranging from 0 to 30 inches. A spring-loaded spur attachment (not shown) may be mounted to the rear of the outer strap 14 to reduce downward travel in icy pole conditions.

The lineman ascends by grasping the handle/paddle assembly 22 in one hand and the carabiner connector 20 in the other hand. Before ascending, a minimum clearance of approximately one-third the circumference of the pole 30 between the handle/paddle 22 and the carabiner connector "D" piece 18 is required. The wood pole fall protection device 10 shall be capable of cinching the pole 30 without the handle/paddle 22 and the carabiner connector "D" piece 18 touching each other. In the event of a cutout, a properly adjusted wood pole fall protection device 10 will be able to tighten, thereby preventing a fall.

There should be a space 36 of approximately 1 to 2 inches from the pole 30 to the inner strap 12 as shown in FIG. 2. With the device 10 properly adjusted, a lineman can lean forward to create slack around the pole 30, and be able to slide the outer strap 14 up or down the pole 30 using the hitchhike method. By leaning back into the device 10, the device 10 will cinch around the pole 30. The lineman then adjusts as necessary to accommodate for pole taper.

To be in a correct position to work, the lineman leans back to allow the outer strap 14 to cinch the pole 30 and adjusts the length of the inner strap 12 for a comfortable work position. While in the work position, the lineman can freely rotate the inner strap 12 through integrated rollers (not shown) in the respective buckles to gain rotational movement while working.

To move around the pole, the lineman must lean forward to gain slack, reposition his feet in the direction desired, and rotate the inner strap 12. Once in the desired position, the lineman leans back to allow the outer strap 14 to cinch the pole 30.

To climb over obstructions such as a telephone cable or cross arm (not shown), the lineman leans back to allow the outer strap 14 to cinch the pole 30. Then, the retractable lanyard (not shown) can be connected to the opposite body belt "D" ring (not shown). Once the retractable lanyard is secure over the obstruction, the tension is released on the outer strap 14 by depressing the handle/paddle 22 on the cam buckle assembly 24 and lengthening the strap. Once the outer strap 14 is lengthened, the carabiner connector 20 is pulled around the front and disconnected. The lineman climbs a few steps up and adjusts as necessary to accommodate for pole taper and the wood pole fall protection device 10 can be reconnected over the obstruction. The retractable lanyard snap hook is disconnected and the lineman continues to ascend. This is repeated as necessary until the desired work position is reached. To descend, the same adjustment as ascending is maintained, allowing the device 10 to tighten around the pole 30 in the event of a cutout.

The hitchhike method must always be used, as opposed to the hand over hand method, which should never be used, as the hand over hand method allows the device 10 to simply fall down the pole 30 on its own. In the event of a fall, the hand over hand method may allow the device 10 to loosen and fall below the lineman's waist, which may not allow the device 10 enough time to cinch around the pole 30.

The wood pole fall protection device 10 is adjusted as necessary to accommodate for pole taper. Once standing on the ground, the inner strap 12 is disconnected from the outside strap 14, and the device 10 is removed from the pole 30.

Figure 3:
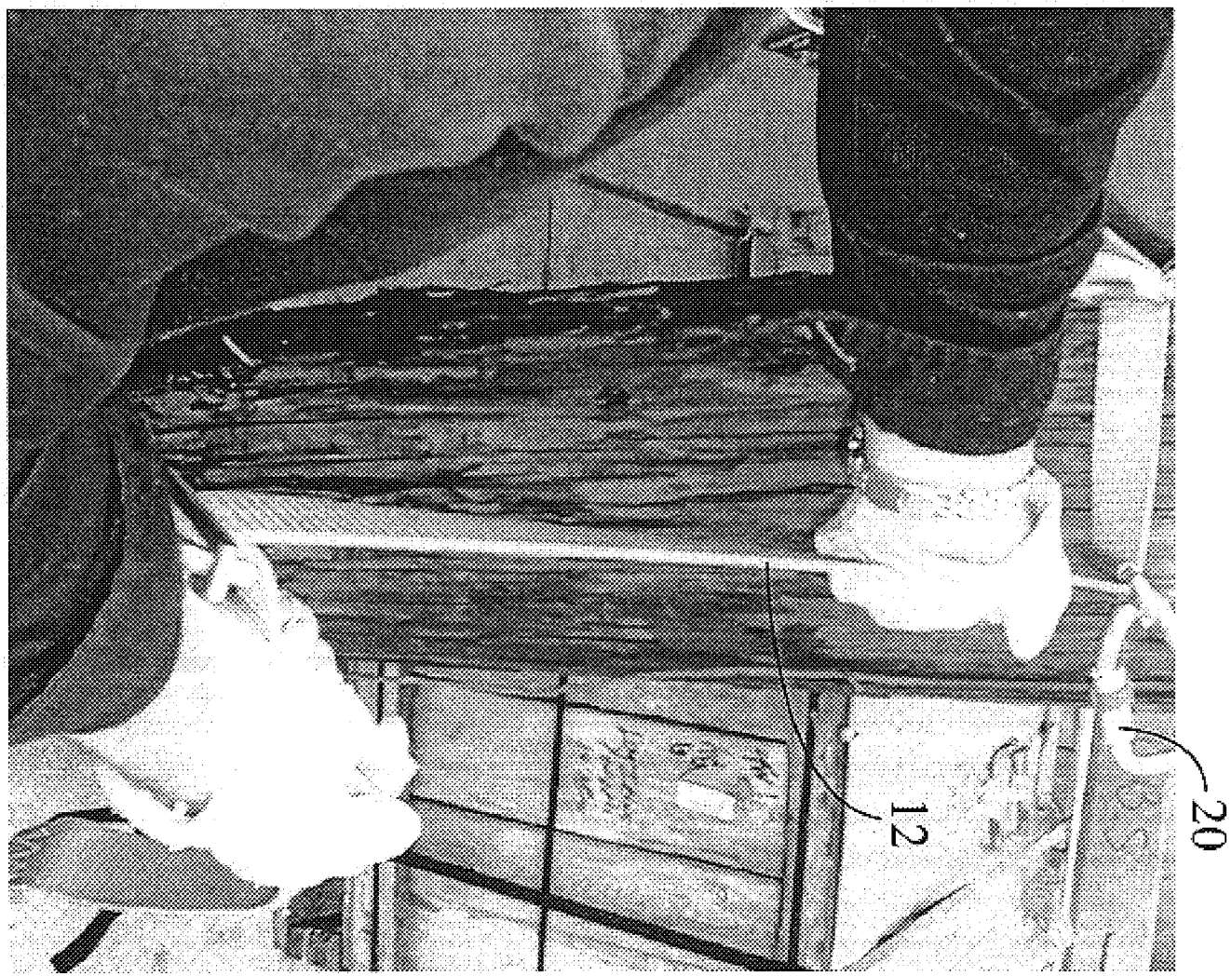
FIG. 3 shows an in situ perspective view of the device illustrated in FIG. 1, as the lineman prepares to shorten the inner strap of the unit.
Figure 4:
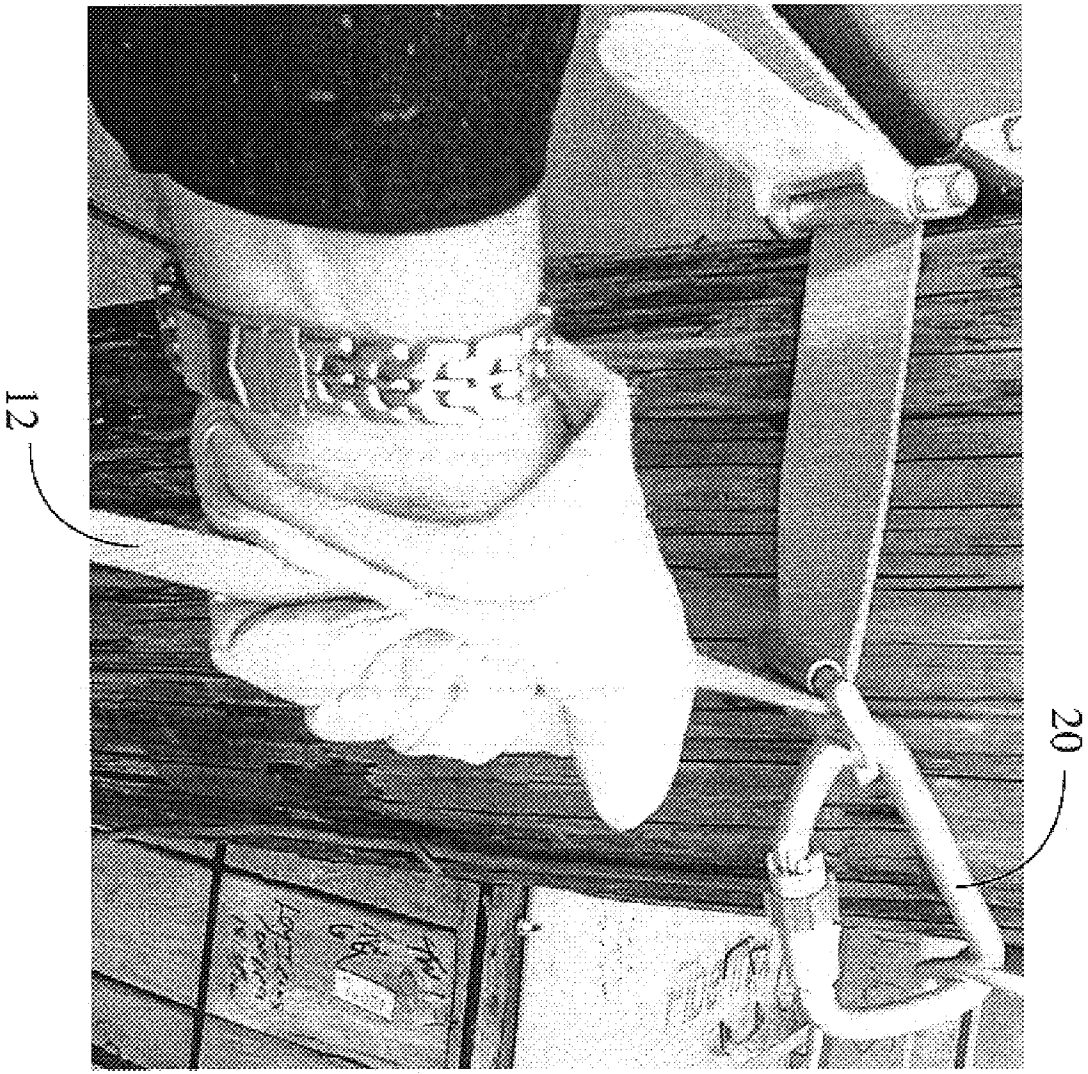
FIGS. 4 and 5 show in situ perspective views of the device illustrated in FIG. 1, as the lineman prepares to lengthen the inner strap of the unit.
Figure 5:
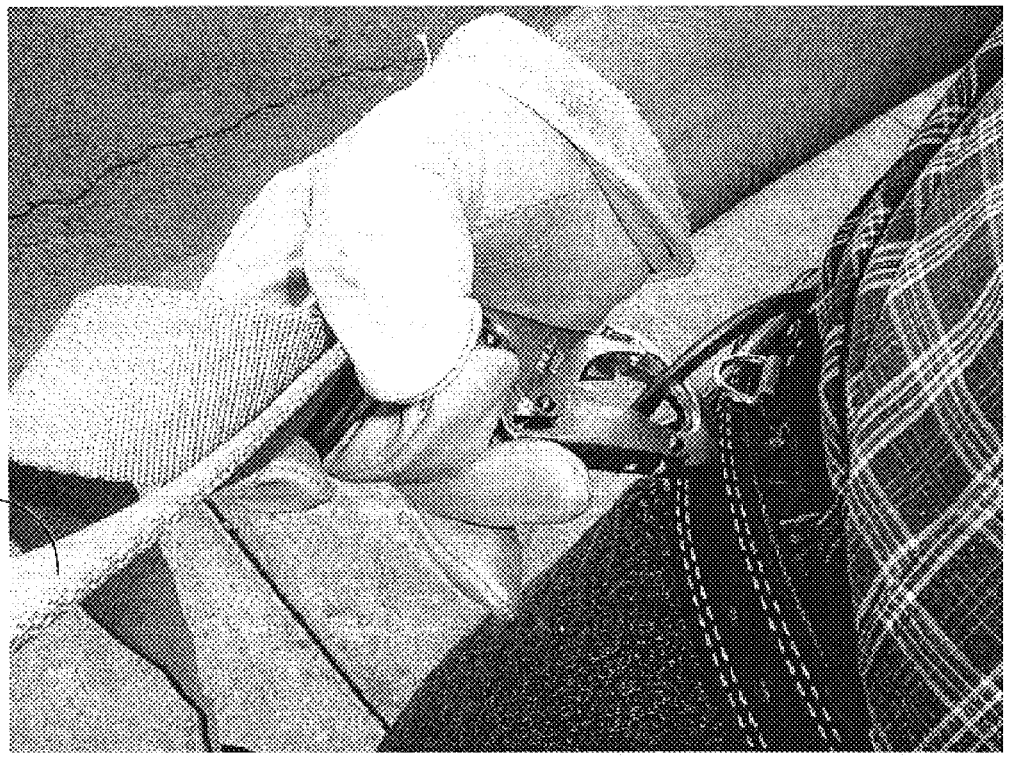

Referring to FIG. 3, the inner strap 12 can be shortened by grasping the web handle 34 and pulling towards the lineman's torso, while the other end of the inner strap 12 is pulled toward the pole 30. To lengthen the inner strap 12, the inner strap 12 is grasped just forward of the carabiner connector 20 and pulled toward the torso (FIG. 4). With the lineman's other hand, the locking snap hook 16 is positioned at an approximate 30-degree angle with the inner strap 12, allowing it to slide through the link 32, as illustrated in FIG. 5. Grasping the inner strap 12 firmly ahead of the carabiner connector 20, the lineman leans back into the device 10 and after applying slight pressure, lengthens the inner strap 12.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A wood pole fall protection device for pole climbers and line technicians that allows said pole climbers and line technicians to negotiate obstacles and obstructions in safety, comprising:

an inner positioning strap;

an outer strap;

a cam buckle assembly through which said outer strap passes, said cam buckle assembly having a first open buckle through which said inner positioning strap passes;

a carabiner connector disposed on a distal end of said outer positioning strap, said carabiner connector having an opening through which said inner positioning strap passes; and an adjustment link disposed on a distal end of said inner positioning strap.

2. The wood pole fall protection device in accordance with claim 1, wherein said carabiner connector comprises a carabiner connector "D" piece.

3. The wood pole fall protection device in accordance with claim 1, further comprising a pair of locking snap hooks respectively disposed on opposite ends of said inner positioning strap.

4. The wood pole fall protection device in accordance with claim 3, wherein said adjustment link is connected to said one of locking snap hooks.

5. A wood pole fall protection device for pole climbers and line technicians that allows said pole climbers and line technicians, using a retractable lanyard attached to a body belt, to negotiate obstacles and obstructions in safety upon a pole, comprising:

an inner strap for attachment to "D" rings of a body belt of a pole climber or line technician;

an outer strap providing adjustment for cinching a pole for movement up and down said pole;

an assembly through which said outer and inner straps pass said assembly having a first open buckle through which the inner strap passes;

connection means disposed on a distal end of said outer strap, said connection means having a second open buckle through which said inner strap passes; and an adjustment link disposed on a distal end of said inner strap.

6. The wood pole fall protection device in accordance with claim 5, wherein said connection means comprises a carabiner connector.

7. The wood pole fall protection device in accordance with claim 5, further comprising a pair of locking snap hooks respectively disposed on opposite ends of said inner strap.

8. The wood pole fall protection device in accordance with claim 5, wherein said adjustment link is connected to one of said locking snap hooks.

9. A wood pole fall protection device for pole climbers and line technicians that allows said pole climbers and line technicians to negotiate obstacles and obstructions in safety upon a pole, comprising:

an inner strap for attachment to "D" rings of a body belt of a pole climber or line technician;

an outer strap providing adjustment for cinching said pole for movement up and down said pole;

an assembly through which the outer strap passes, said assembly having a first open buckle through which said inner strap passes;

a carabiner connector disposed on a distal end of said outer strap, said carabiner connector having a "D" piece through which said inner strap passes; and an adjustment link disposed on a distal end of said inner strap.

10. The wood pole fall protection device in accordance with claim 9, further comprising a pair of locking snap hooks respectively disposed on opposite ends of said inner strap.

11. The wood pole fall protection device in accordance with claim 10, wherein said adjustment link is connected to one of said locking snap hooks.

* * * * *